US011521582B1

(12) United States Patent
Heggelund

(10) Patent No.: US 11,521,582 B1
(45) Date of Patent: Dec. 6, 2022

(54) FRET LEVELING APPARATUS

(71) Applicant: William Lionel Levern Heggelund, Prince George (CA)

(72) Inventor: William Lionel Levern Heggelund, Prince George (CA)

( * ) Notice: Subject to any disclaimer, the term of this patent is extended or adjusted under 35 U.S.C. 154(b) by 0 days.

(21) Appl. No.: 17/456,600

(22) Filed: Nov. 26, 2021

(51) Int. Cl.
*G10D 3/06* (2020.01)
*G10G 7/00* (2006.01)

(52) U.S. Cl.
CPC ..... *G10D 3/06* (2013.01); *G10G 7/00* (2013.01)

(58) Field of Classification Search
CPC ..... G10D 3/06; G10D 3/00; G10G 7/00
See application file for complete search history.

(56) References Cited

U.S. PATENT DOCUMENTS 4,037,510 A * 7/1977 Ginex ..... G10D 3/22 984/115
6,613,969 B1 * 9/2003 Petillo ..... G10D 3/06 84/314 R
2013/0139367 A1 * 6/2013 Bissoli ..... B24D 15/02 81/485

* cited by examiner

*Primary Examiner* — Kimberly R Lockett
(74) *Attorney, Agent, or Firm* — Orin Del Vecchio

(57) ABSTRACT

A fret leveling apparatus that is configured to provide leveling of frets on a fret board of a stringed instrument such as but not limited to a guitar. The present invention includes a body wherein the body in its preferred embodiment is rectangular in shape. The body includes a first end and a second end and further has an upper edge surface and a lower edge surface. The lower edge surface is operable to engage the frets during use of the present invention and has an adhesive material secured thereto. The body includes a first aperture and second aperture having a first height adjustment member and a second height adjustment member operably coupled therein. The first height adjustment member and second height adjustment member are constructed so as to provide calibrated incremental height adjustment of the body with respect to the fret board once placed thereon through rotational movement.

14 Claims, 3 Drawing Sheets

FRET LEVELING APPARATUS

FIELD OF THE INVENTION

The present invention relates generally to musical instrument maintenance and care, more specifically but not by way of limitation, an apparatus for stringed instruments such as but not limited to a guitar wherein the apparatus of the present invention is configured to provide simultaneous leveling of all frets present on the neck of a stringed instrument.

BACKGROUND

Millions of people play various types of musical instruments either for recreational enjoyment or some play professionally. There are numerous types of musical instruments that are grouped into four main categories of string, brass, woodwind and percussion. In the stringed instrument category these types of instruments can be embodied instruments such as but not limited to the banjo, cello, violin and guitar. While the stringed instruments vary from size, shape and musical intent, these stringed instruments have in common a neck board, strings superposed adjacent an upper surface of the neck board and frets. In guitar construction very little has changed when it comes to how frets are installed on the neck board. While there have been many technology changes in just about every aspect of the guitar, frets have remained largely unchanged in their basic functionality. Frets are still just ribbons of metal often called fret wire that are pressed into the fret board(or neck) at precise increments determined by the scale length of the guitar. Many builders still utilize the same basic tools that were used a century ago during the manufacturing process.

Fret leveling occurs not only during the manufacturing process but is part of a player's routine maintenance to ensure performance and desired musical production. Subsequent all of the frets being secured into the fret board it is crucial that all of the frets are level to one another. If a fret is higher or lower than the rest it will diminish a guitar from a playability standpoint. Regardless of how well the guitar is setup, with an uneven fret, the guitar will more than likely buzz when strings are fretted in the proximity of the high/low fret. Additionally, unlevel frets will have a significant negative impact on the intonation. Great players understand this and will take a great deal of care and time to make sure that all the frets are level on a routine basis. Existing technology accomplishes through utilization of sanding blocks and files. While these are somewhat effective, they require a great deal of skill and they do not provide functionality such as but not limited to controllable height and the ability to sand all of the frets on the fret board.

Accordingly, there is a need for a fret leveling apparatus that is configured to assist a user in leveling all of the frets on a fret board wherein the present invention provides the ability to incrementally adjust the height of the body so as to ensure leveling of all frets providing uniformity across the fret board and provide the ability to engage all frets at the same time.

SUMMARY OF THE INVENTION

It is the object of the present invention to provide a fret leveling apparatus configured to be utilized to level frets on a stringed instrument such as but not limited to a guitar wherein the present invention includes a body manufactured from a lightweight rigid material and further having an elongated straight edge.

Another object of the present invention is to provide a guitar fret leveling apparatus that is operable to provide leveling of all of the frets located on the fret board wherein the body of the present invention includes a first end and a second end.

A further object of the present invention is to provide a fret leveling apparatus configured to be utilized to level frets on a stringed instrument such as but not limited to a guitar wherein the body includes a first height adjustment member and a second height adjustment member proximate opposing ends of the body.

Still another object of the present invention is to provide a guitar fret leveling apparatus that is operable to provide leveling of all of the frets located on the fret board wherein the present invention employs a three point neck straightening system.

An additional object of the present invention is to provide a fret leveling apparatus configured to be utilized to level frets on a stringed instrument such as but not limited to a guitar wherein the three point neck straightening system includes three support members configured to be releasably engaged with the body.

Yet a further object of the present invention is to provide a guitar fret leveling apparatus that is operable to provide leveling of all of the frets located on the fret board wherein the present invention includes height adjustment to 0.0015 inches.

Another object of the present invention is to provide a fret leveling apparatus configured to be utilized to level frets on a stringed instrument such as but not limited to a guitar wherein the body includes a first edge surface and a second edge surface.

Still an additional object of the present invention is to provide a guitar fret leveling apparatus that is operable to provide leveling of all of the frets located on the fret board wherein the second edge surface includes an abrasive surface superposed thereon.

Yet another object of the present invention is to provide a fret leveling apparatus configured to be utilized to level frets on a stringed instrument such as but not limited to a guitar wherein the body includes a first glide bearing and a second glide bearing placed adjacent the twelfth and second fret space on the fret board.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
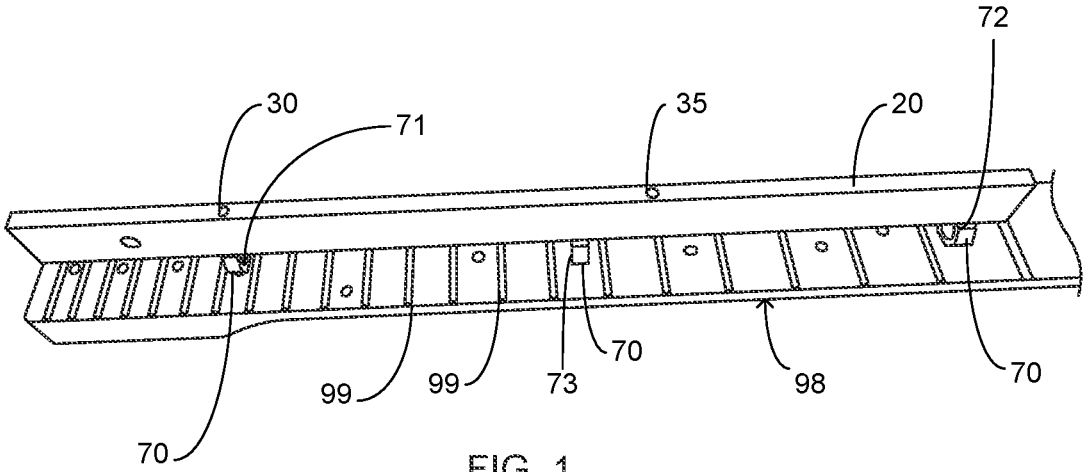
FIG. 1 is a perspective view of the present invention during a neck straightening procedure.
Figure 2:
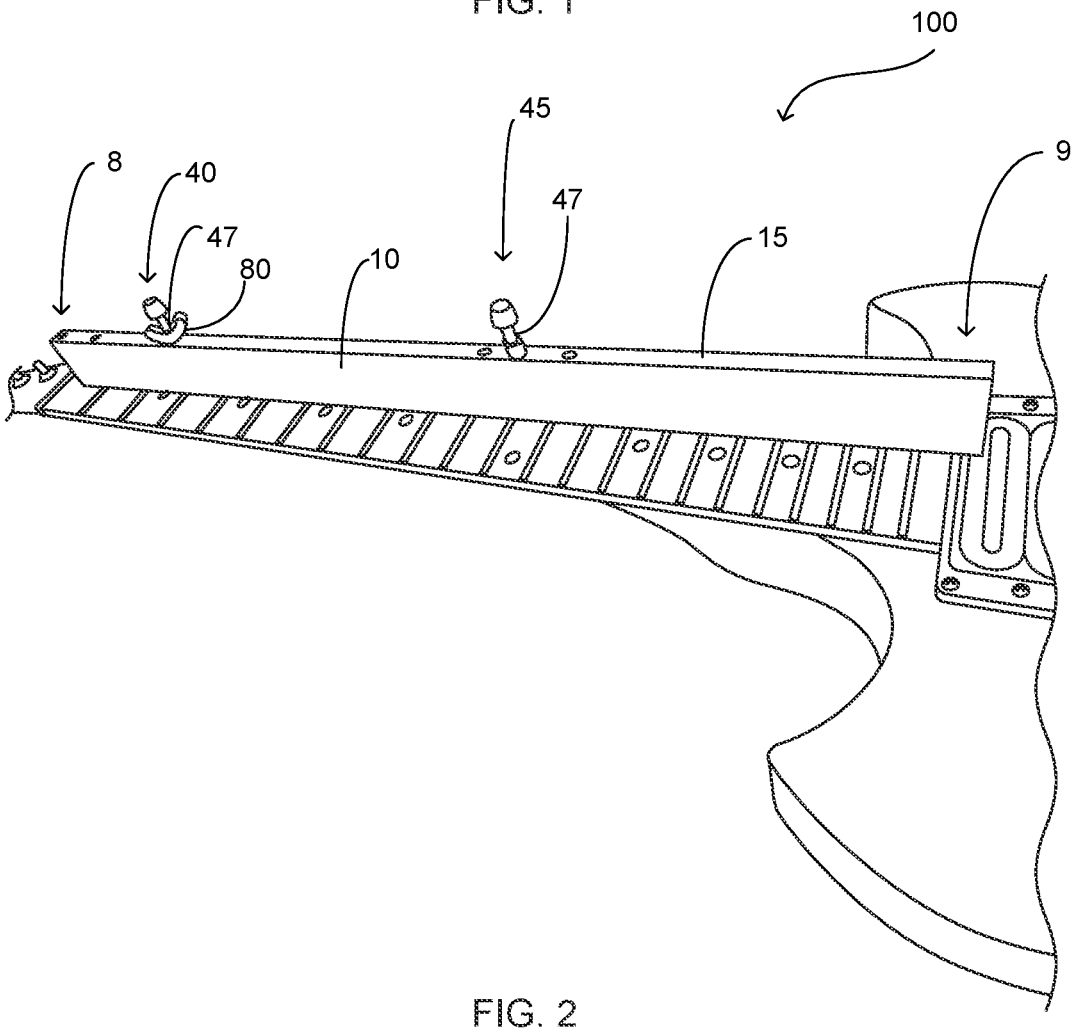
FIG. 2 is a perspective view of the present invention on an exemplary fret board of a guitar.

Referring now to the drawings submitted herewith, wherein various elements depicted therein are not necessarily drawn to scale and wherein through the views and figures like elements are referenced with identical reference numerals, there is illustrated a fret leveling apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the fret leveling apparatus 100 includes a body 10. The body 10 includes first end 8 and second end 9. The body 10 is rectangular in shape in a preferred embodiment and is manufactured from a lightweight rigid material such as but not limited to 6061 aluminum. The body 10 in a preferred embodiment has a width of three-eighths of an inch. This width is desirable for improved fret board radius control. While a width of three-eighths of an inch is desired in the preferred embodiment, it is contemplated within the scope of the present invention that the body 10 could be provided in alternate widths. It is further contemplated within the scope of the present invention that the body 10 could be provided in alternate lengths such as but not limited to twelve inches, eighteen inches and twenty-four inches. The body 10 includes an upper edge surface 15 and a lower edge surface 20. The lower edge surface 20 is configured to be superposed the frets 99 located on the fret board 98 during utilization of the fret leveling apparatus 100. The lower edge surface 20 includes an adhesive surface superposed thereon wherein the adhesive surface is operable to engage the frets 99 and provide sanding thereof. In a preferred embodiment of the present invention a pressure sensitive adhesive backed sandpaper is releasably secured to the lower edge surface 20.

Figure 3:
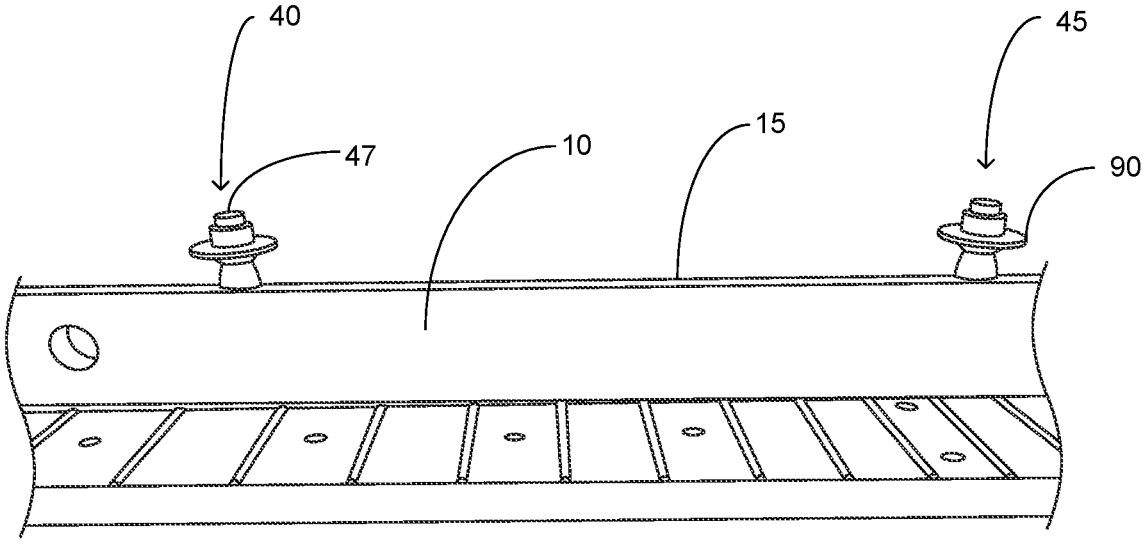
FIG. 3 is a detailed view of the height adjustment members operably coupled to the body of the present invention.

Journaled through the body 10 extending from the upper edge surface 15 to the lower edge surface 20 are a first aperture 30 and a second aperture 35. The first aperture 30 and second aperture 35 are configured so as to receive the first height adjustment member 40 and second height adjustment member 45 therein as is further discussed herein. As shown particularly in FIG. 3, the body 10 can be utilized to provide straightening of the fret board 98 prior to leveling the frets 99. The body 10 is releasably engaged with the support members 70 as illustrated herein in FIG. 1. The support members 70 are manufactured from a suitable durable material such as but not limited to metal and place the body 10 in an elevated position over the fret board 98. The outer support members 71,72 are utilized initially and the middle support member 73 is deployed last. As is known in the art guitar necks have elements such as but not limited to tension bars to provide straightening of the neck. Prior to fret leveling it must be ensured that the neck is straight. The body 10 of the present invention is placed on the outer support members 71,72 and a user will engage the element that provides straightening of the neck such as but not limited to a tension bar. Once a user believes they are proximate a straight orientation for the neck, the middle support member 73 is placed intermediate the outer support members 71,72 to verify that equal engagement of all of the support members 70 is achieved. Subsequent equal engagement of all of the support members 70, a user of the fret leveling apparatus 100 has validated that the neck is straight and level and can proceed to execution of leveling of the frets 99. In a preferred embodiment, the support members 70 are of equal size to include thicknesses thereof.

During the fret leveling process the lower edge surface 20 is superposed the frets 99. The first height adjustment member 40 and second height adjustment member 45 are secured in first aperture 30 and second aperture 35 respectively. The first height adjustment member 40 and second height adjustment member 45 are identically constructed and are operable to provide height adjustment of the body 10 to a desired height above the fret board 98. The first height adjustment member 40 and second height adjustment member 45 are rotationally movable in order to provide the desired height adjustment of the body 10. The first height adjustment member 40 and second height adjustment member 45 include a post member 47 manufactured from a suitable material such as but not nylon. It should be understood within the scope of the present invention that the post member 47 is a threaded nylon rod or similar structure and a material such as nylon is preferred as the ends of the post member will engage the upper surface of the fret board 98 during utilization of the fret leveling apparatus 100. As height adjustment of the first height adjustment member 40 and second height adjustment member 45 is critical and the adjustment thereof being desirably very précised controlled movements, it is contemplated within the scope of the present invention that the first height adjustment member 40 and second height adjustment member 45 be manufactured to provide calibrated rotational movements in order to provide controlled height movements of the body 10 in measurements such as but not limited to 0.0015 of an inch. By way of example but not limitation the first height adjustment member 40 and second height adjustment member 45 could be rotated in 1/8 calibrated turns. Once the desired height is reached the locking members 80 are engaged so as to maintain the first height adjustment member 40 and second height adjustment member 45 in the desired height so as to level the intended frets 99. It should be understood within the scope of the present invention that the locking members 80 could be constructed in alternate manners in order to achieve the desired objective of maintain the positions of the first height adjustment member 40 and second height adjustment member 45.

The location of the first aperture 30 and second aperture 35 and as such the first height adjustment member 40 and second height adjustment member 45 results in placement of the first height adjustment member 40 adjacent the second fret of a guitar fret board and the second height adjustment member 45 adjacent the twelfth fret. During use of the body 10 the body 10 is moved in a longitudinal back and forth motion with respect to the fret board 98 and the aforementioned placement of the first height adjustment member 40 and second height adjustment member 45 provides the desired control and results. It should be understood within the scope of the present invention that the first height adjustment member 40 and second height adjustment member 45 could be placed in alternate locations along the length of the body 10 in particular so as to be adapted for alternate types of stringed instruments. Embodiments of the locking members 80 illustrated in FIG. 3 herein are calibrated rotational discs secured to central post member 47 with a frictional clutch, described later herein, which provides the ability to zero the position of the first height adjustment member 40 and second height adjustment member 45 and subsequently provide calibrated very small incremental movement thereof. It should be understood within the scope of the present invention that the first height adjustment member 40 and second height adjustment member 45 could be moved in a calibrated manner utilizing various alternate mechanical components. It is further contemplated within the scope of the present invention that the body 10 could have a third aperture wherein the third aperture would be proximate the fourth fret 99 during utilization of the fret leveling apparatus 100.

Figure 4:
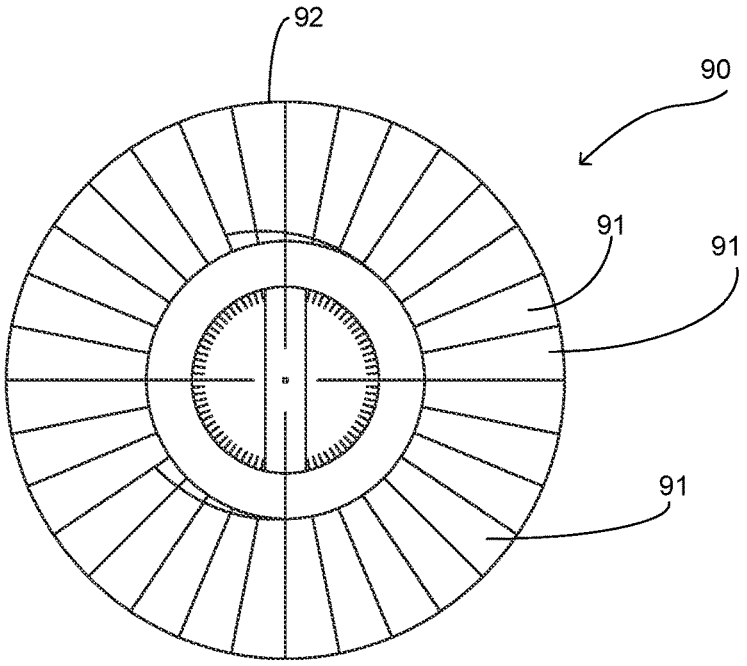
FIG. 4 is a detailed top view of the calibration disc of the height adjustment member of the present invention.
Figure 5:
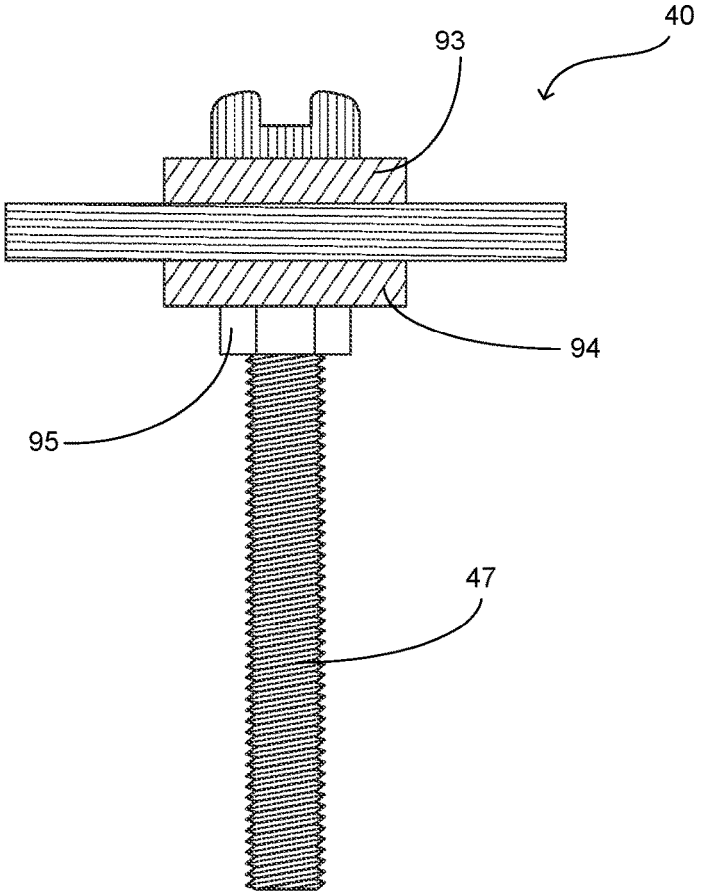
FIG. 5 is a detailed side view of an embodiment of the height adjustment member of the present invention.

Referring now to FIGS. 4 and 5 submitted as a part hereof, there are detailed views of the height adjustment member 40 provided therein. As discussed herein, the body 10 is moved in a vertical manner in order to achieve the desired position in order to accomplish the desired sanding and leveling of the frets 99. In order to achieve the micro-adjustments preferred in the execution of the aforementioned task the height adjustment member 40 in its preferred embodiment includes a calibration disc 90. The calibration disc 90 includes calibration segments 91 that are operable to provide a controlled incremental rotational movement of the calibration disc 90 and as such a controlled height adjustment of the height adjustment member 40. The calibration segments 91 in a preferred embodiment have a width proximate the outer edge 92 of .001 inches. It should be understood within the scope of the present invention that the calibration segments 91 could be provided in alternate sizes. An upper clutch member 93 and a lower clutch member 94 are operably engaged with the calibration disc 90 on opposing sides thereof. The upper clutch member 93 and lower clutch member 94 are configured to frictionally engage the calibration disc 90 and the calibration segments 91 thereof in order to provide the desired precise movement so as to control the adjustment of the height of the height adjustment member 40. Clutch adjustment mechanism 95 is secured to the post member 47. While a particular configuration of the height adjustment member 40 has been illustrated and discussed herein, it is contemplated within the scope of the present invention that a calibrated height adjustment of the height adjustment member 40 could be achieved through alternate elements in addition to or in conjunction with the elements discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A fret leveling apparatus operable to provide leveling of frets on a stringed instrument wherein the fret leveling apparatus comprises:

a body, said body having a first end and a second end, said body having an upper edge surface and a lower edge surface, said upper edge surface and said lower edge surface being straight;

a first aperture and a second aperture, said first aperture being proximate said first end of said body, said second aperture being proximate said second end of said body, said first aperture and said second aperture being journaled through said body from said upper edge surface to said lower edge surface;

a first height adjustment member, said first height adjustment member being operably coupled with said first aperture, said first height adjustment member having a central post member, said first height adjustment member configured to adjust a height of the body relative to a fret board;

a second height adjustment member, said second height adjustment member being operably coupled with said second aperture, said second height adjustment member having a central post member, said second height adjustment member configured to adjust a height of the body relative to a fret board.

2. The fret leveling apparatus as recited in claim 1, wherein said first height adjustment member and said second height adjustment member are rotationally movable within said first aperture and said second aperture.

3. The fret leveling apparatus as recited in claim 2, and further including two outer support members, said two support members being configured to releasably engage said upper edge surface of said body when said body is being utilized during a neck straightening procedure for a stringed instrument.

4. The fret leveling apparatus as recited in claim 3, and further including a middle support member, said middle support member being placed intermediate the two outer support members during the neck straightening procedure, said middle support member configured to releasably engage the upper edge surface of the body to ensure orientation of the neck of the stringed instrument.

5. The fret leveling apparatus as recited in claim 4, wherein said first height adjustment member includes a locking member operably coupled thereto, said locking member configured to maintain a position of the first height adjustment member.

6. The fret leveling apparatus as recited in claim 5, wherein said body is rectangular in shape and has a width of three-eighths of an inch.

7. The fret leveling apparatus as recited in claim 6, wherein said second height adjustment member includes a locking member operably coupled thereto, said locking member coupled to said second height adjustment member configured to maintain a position of the first height adjustment member.

8. The fret leveling apparatus as recited in claim 7, and further including calibrated movement members, said calibrated movement members being operably coupled to said first height adjustment member and said second height adjustment member, said calibrated movement members configured to assist in adjustment of a vertical height of the body with respect to a fret board.

9. The fret leveling apparatus as recited in claim 8, wherein said first height adjustment member and said second height adjustment member provides height adjustments in increments of 0.0015 inches.

10. The fret leveling apparatus as recited in claim 9, wherein the central post member of the first height adjustment member and second height adjustment member are manufactured from thread nylon rod.

11. The fret leveling apparatus as recited in claim 10, wherein the body is manufactured from aluminum.

12. The fret leveling apparatus as recited in claim 11, wherein the body is moved in a longitudinal back and forth motion with respect to the fret board during use of the fret leveling apparatus.

13. The fret leveling apparatus as recited in claim 12, wherein the first height adjustment member engages the fret board proximate a second fret location.

14. The fret leveling apparatus as recited in claim 13, wherein the second height adjustment member engages the fret board proximate a twelfth fret location.

* * * * *